US007966847B2

(12) United States Patent
Norris

(10) Patent No.: US 7,966,847 B2
(45) Date of Patent: Jun. 28, 2011

(54) ELONGATION RESISTANT FABRIC AND DEVICES

(75) Inventor: Stephanie Booz Norris, Rocky Point, NC (US)

(73) Assignee: Atex Technologies, Inc., Pinebluff, NC (US)

( * ) Notice: Subject to any disclaimer, the term of this patent is extended or adjusted under 35 U.S.C. 154(b) by 67 days.

(21) Appl. No.: 12/403,789

(22) Filed: Mar. 13, 2009

(65) Prior Publication Data

US 2009/0240103 A1 Sep. 24, 2009

Related U.S. Application Data

(60) Provisional application No. 61/036,239, filed on Mar. 13, 2008.

(51) Int. Cl.
*D04B 21/00* (2006.01)

(52) U.S. Cl. ..... 66/192; 66/195

(58) Field of Classification Search ..... 66/172 E, 66/190, 192, 193, 195
See application file for complete search history.

(56) References Cited

U.S. PATENT DOCUMENTS

| | | | | |
|---|---|---|---|---|
| 3,077,758 | A * | 2/1963 | Siciliano | 66/192 |
| 3,552,154 | A * | 1/1971 | Lesley | 66/192 |
| 4,009,597 | A * | 3/1977 | Wall et al. | 66/193 |
| 5,393,596 | A * | 2/1995 | Tornero et al. | 66/195 |
| 5,457,968 | A * | 10/1995 | McClintock et al. | 66/202 |
| 5,522,240 | A | 6/1996 | Wall et al. | |
| 6,652,595 | B1 | 11/2003 | Nicolo | |
| 6,840,066 | B2 * | 1/2005 | Dickerson | 66/192 |
| 6,984,596 | B2 * | 1/2006 | Dickerson | 66/195 |
| 7,131,944 | B2 | 11/2006 | Jacquetin | |
| 7,175,591 | B2 | 2/2007 | Kaladelfos | |
| 7,410,460 | B2 | 8/2008 | Benderev | |
| 2005/0228408 | A1 | 10/2005 | Fricke et al. | |

FOREIGN PATENT DOCUMENTS

| | | |
|---|---|---|
| EP | 1344856 | 9/2003 |
| WO | WO 2006111664 | 10/2006 |

OTHER PUBLICATIONS

PCT/US2009/037098, International Search Report, Jul. 8, 2009.
PCT/US2009/037098, Written Opinion of the International Searching Authority, Jul. 8, 2009.
PCT/US2009/037098, Amendments Under Article 19 PCT, Sep. 8, 2009.

* cited by examiner

*Primary Examiner* — Danny Worrell
(74) *Attorney, Agent, or Firm* — Boggs IP Law, LLC

(57) ABSTRACT

An elongation resistant fabric, devices, and methods can include an elongation resistant yarn laid in a knit structure of the fabric between knit loops in selected adjacent wales and partially about the loop in one adjacent wale in predetermined courses. In this manner, the fabric can be adapted to resist elongation in a walewise direction along the length of the fabric. The elongation resistant fabric can be a mesh fabric. In a mesh fabric, the size and a shape of pores in the fabric can be maintained when the fabric is pulled in the walewise direction. The elongation resistant yarn can have a diameter larger than the individual diameters of other yarns in the fabric. The elongation resistant yarn can be, for example, a monofilament yarn, such as a polypropylene or polyester monofilament yarn.

19 Claims, 2 Drawing Sheets

ELONGATION RESISTANT FABRIC AND DEVICES

CROSS-REFERENCE TO RELATED APPLICATION

This application claims benefit of U.S. Provisional Patent App. No. 61/036,239, filed Mar. 13, 2008, which application is incorporated by reference herein in its entirety.

FIELD OF THE INVENTION

The present invention relates to an elongation resistant fabric and devices comprising the elongation resistant fabric. Such elongation resistant fabric and devices may be useful in medical applications.

BACKGROUND OF THE INVENTION

Knitted mesh fabrics often have an inherently high elongation characteristic due to the nature of the loop construction in the fabric and the open mesh, or pores, in the fabric design. For example, some conventional mesh fabrics having a two-bar mesh construction can have an elongation of about 64 percent with five lbs. of pulling force. Such high degrees of elongation can cause the mesh fabric to elongate, or stretch in a longitudinal fashion, further than desired. For example, when a high-elongation mesh is used to contain and hold an object adjacent or near a desired location, the weight of the object can cause the mesh to elongate to the point that the object is no longer adjacent or near the desired location.

Various approaches to decreasing elongation in mesh fabrics have been attempted. In some conventional approaches, elongation capability in a particular mesh design may be reduced by modifying the mesh design itself, for example, by decreasing the size of the mesh openings. In other conventional approaches, the elongation capability of a mesh fabric may be decreased by knitting the fabric with yarns having less elasticity. Such approaches can have disadvantages. For example, decreasing the size of the mesh openings may alter the usefulness of the fabric for its intended purpose, which may require having larger, more breathable mesh openings. Knitting mesh fabrics with yarns having less elasticity may decrease the size of the mesh openings, and may otherwise undesirably change the performance characteristics of the fabric. In addition, using more, larger, and/or less elastic yarns in a knitted mesh fabric can add undesired density to the fabric, as well as increased construction costs.

Thus there is a need for a mesh fabric having a reduced elongation characteristic that preserves the integrity of openings in the mesh design and the performance characteristics of the mesh fabric.

SUMMARY

Figure 1:
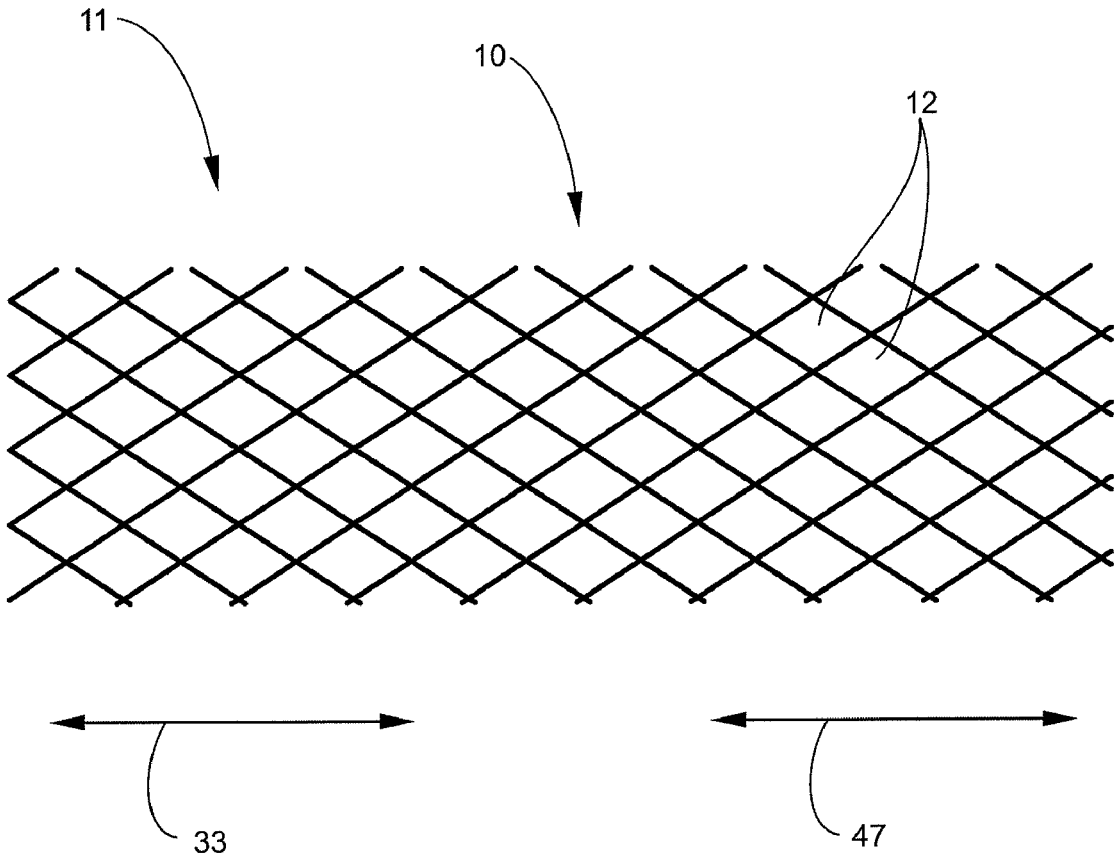
FIG. 1 is a view of a mesh fabric having a reduced elongation characteristic in an embodiment of the present invention.

Some embodiments of the present invention can include an elongation resistant fabric, devices comprising the elongation resistant fabric, and methods of making the elongation resistant fabric. In some embodiments, the elongation resistant fabric can include an elongation resistant yarn laid in a knit structure of the fabric between knit loops in selected adjacent wales and partially about the loop in one adjacent wale in predetermined courses. In this manner, the fabric can be adapted to resist elongation in a walewise direction along the length of the fabric. In some embodiments, the elongation resistant fabric can comprise a mesh fabric. In an embodiment of a mesh fabric, the size and a shape of pores in the mesh fabric can be maintained when the fabric is pulled in the walewise direction.

In certain embodiments, the mesh fabric can be constructed as a raschel-knit mesh fabric. In such a mesh fabric, each wale can comprise a front yarn knit in loops from a first guide bar and a back yarn knit about the front yarn loops from a second guide bar in each course of the fabric structure. The elongation resistant yarn can be laid in the fabric structure from a third guide bar partially about the loop of the front yarn in one adjacent wale in predetermined courses.

In some embodiments, the elongation resistant fabric can be laid in partially about the loop in one adjacent wale in every sixth course along the length of the fabric. In some embodiments, the elongation resistant yarn can be laid in between each wale. In other embodiments, the elongation resistant yarn can be laid in between every third wale.

In some embodiments, the elongation resistant yarn can comprise a diameter larger than the individual diameters of other yarns in the fabric. In certain embodiments, the elongation resistant yarn can comprise a monofilament yarn. In certain embodiments, the monofilament yarn can comprise polypropylene or polyester. The monofilament yarn can comprise a diameter in the range of 2 mil-12 mil.

In some embodiments, the present invention can include a device comprising an elongation resistant fabric comprising an elongation resistant yarn laid in a knit structure of the fabric between knit loops in selected adjacent wales and partially about the loop in one adjacent wale in predetermined courses. In such a device the fabric is adapted to resist elongation in a walewise direction along a length of the fabric. In certain embodiments, the device fabric can be a mesh fabric. In certain embodiments, the elongation resistant yarn in the device can comprise a diameter larger than the individual diameters of other yarns in the device fabric. Particular embodiments of the device can comprise an implantable medical device, for example, an organ support device.

In some embodiments, the present invention can include a method, comprising constructing an elongation resistant fabric adapted to resist elongation in a walewise direction along a length of the fabric. Such construction can include laying in an elongation resistant yarn between knit loops in selected adjacent wales, and laying in the elongation resistant yarn partially about the loop in one adjacent wale in predetermined courses. In certain embodiments, the elongation resistant fabric constructed in such a method can comprise a mesh fabric.

In certain embodiments, a method of constructing an elongation resistant fabric can further include knitting on a raschel knitting machine a front yarn from a first guide bar in loops in each wale. A back yarn can be knit from a second guide bar about the front yarn loops in each course of the fabric. The elongation resistant yarn can be laid in from a third guide bar partially about the loop of the front yarn in one adjacent wale in predetermined courses. In certain embodiments, the elongation resistant yarn can be laid in every sixth course along the length of the fabric. In certain embodiments of a method, the elongation resistant yarn can comprise a monofilament yarn.

Features of an elongation resistant fabric, devices, and/or methods may be accomplished singularly, or in combination, in one or more of the embodiments of the present invention.

As will be realized by those of skill in the art, many different embodiments of an elongation resistant fabric, devices, and/or methods are possible. Additional uses, advantages, and features of aspects of the present invention are set forth in the illustrative embodiments discussed in the detailed description herein and will become more apparent to those skilled in the art upon examination of the following.

DETAILED DESCRIPTION

Figure 2:
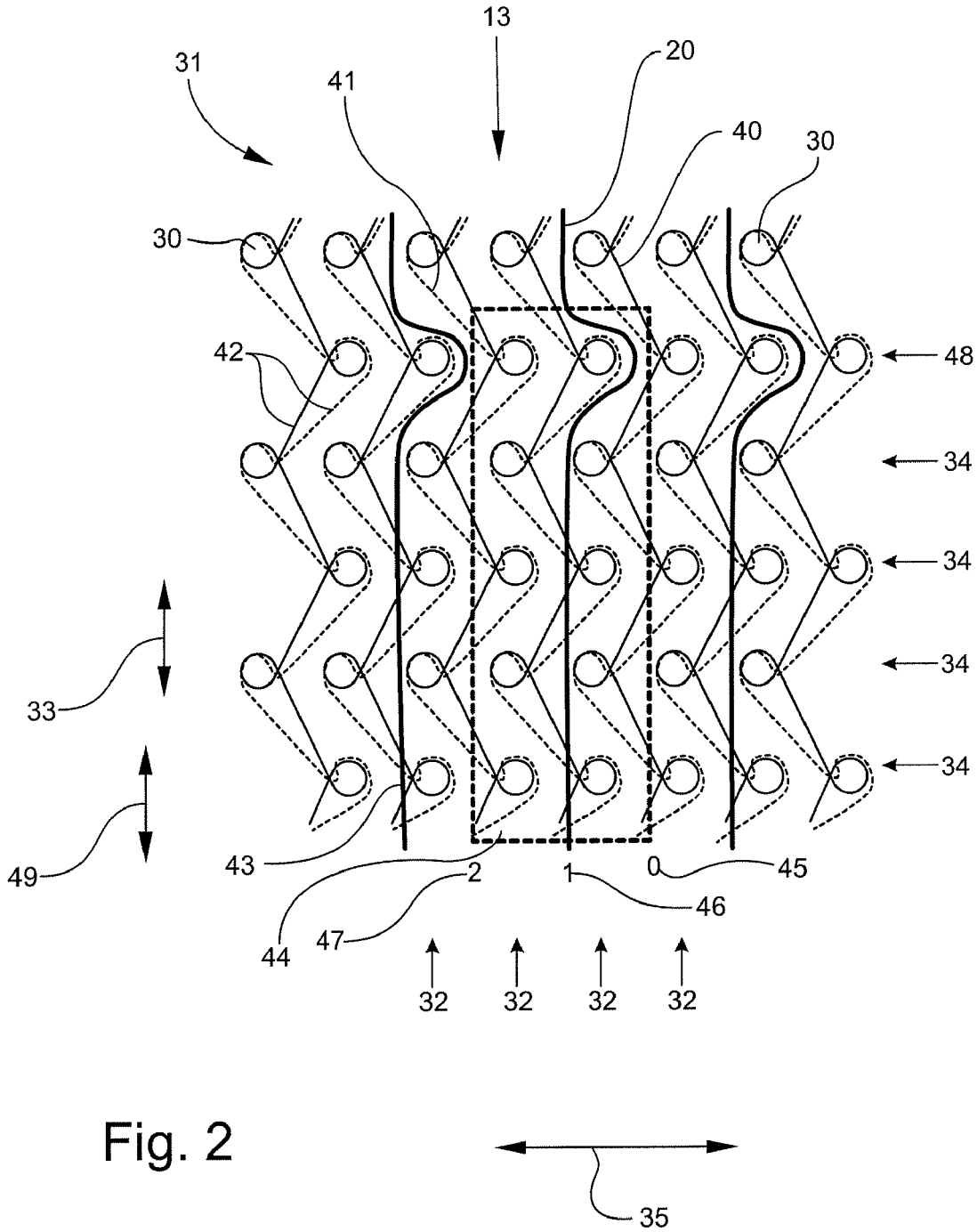
FIG. 2 is a stitch diagram of an elongation resistant mesh fabric in an embodiment of the present invention.

Some embodiments of the present invention can provide an elongation resistant fabric and devices comprising the elongation resistant fabric. FIGS. 1 and 2 illustrate embodiments of such an elongation resistant fabric 10. FIG. 1 shows an embodiment of a mesh fabric 11 having a particular size (relatively large size) mesh pore 12 and a reduced elongation characteristic. FIG. 2 shows an embodiment of an elongation resistant mesh fabric stitch diagram 13. In such embodiments, the mesh fabric 11 can maintain properties that allow the mesh fabric 11 to function for its intended use. Such properties can include, for example, the size and/or shape of the mesh openings, or pores 12, which can remain relatively unchanged during use of the mesh fabric 11. Such embodiments of the mesh fabric 11 can include a fabric construction 31 comprising an elongation resistant yarn 20. The elongation resistant yarn 20 can serve as a tensioning mechanism that can restrict elongation of the mesh fabric 11 while maintaining the original integrity of the mesh design. Maintaining integrity of mesh fabric design refers to, among other things, maintaining the size and shape of the pores 12 in the mesh fabric 11. In certain embodiments, the elongation resistant yarn 20 can be "laid in" between knit loops 30 during warp knitting of the fabric 10.

As shown in the stitch diagram 13 in FIG. 2, the warp knit mesh construction 31 can include a plurality of wales 32, each wale 32 having a series of loops 30 formed by the action of one needle in successive courses 34, along the fabric length 33. A course 34 is defined as a row of loops 30 or stitches running across the width 35 of the fabric 10. The embodiment of the stitch diagram 13 in FIG. 2 depicts a three-bar fabric. A guide bar is defined as a bar across the width of a warp knitting machine that holds a series of yarn guides. Each yarn guide, or eyelet, can be threaded with one or more yarns. Movements of guide bars carry warp yarns to knitting needles and can wrap the yarns around the needles. Each yarn in an eyelet in a particular guide bar makes the same movement. Warp knitting machines and warp knit fabrics can be referred to by the number of guide bars in the knitting machine required to knit the fabric, for example, a three-bar mesh, knit using three guide bars.

Some embodiments of the elongation resistant fabric 10 of the present invention can comprise fabrics knit in various manners or styles. For example, some embodiments of such a fabric 10 can be raschel-knit, others can be tricot-knit, and still others can be knit in various other manners. In the embodiment of the raschel-knit mesh fabric 11 illustrated in FIG. 2, the first guide bar carries the yarns to be knit on the front face of the fabric 11. The first guide bar includes "solid" threading. That is, each eyelet in the first guide bar carries a front yarn 40. In this way, each wale 32 in the knitted fabric 11 can include the front yarn 40. The second guide bar carries the yarns to be knit on the back face of the fabric 11. The second guide bar includes "solid" threading, such that each eyelet in the second guide bar carries a back yarn 41. As a result, each wale 32 in the knitted fabric 11 can include the back yarn 41. The third guide bar carries the elongation resistant yarns 20 to be "laid in" the fabric structure. The third guide bar includes "1-in, 1-out" threading, or alternating (or half gauge) threading, such that every other eyelet in the third guide bar carries an elongation resistant yarn 20. In this way, the elongation resistant yarn 20 can be "laid in" between knitted loops 30 between alternating wales 32 in the mesh fabric 11.

In some embodiments, the elongation resistant yarn 20 can be "laid in" the fabric structure. In a "laid-in" fabric, a base structure of knitted or overlapped (warp knitted) threads 42 hold in position other non-knitted threads 43 which are incorporated, or "laid-in," the structure during the same knitting cycle. Although the inlaid yarn 43 is not formed into a knitted loop 30 since it does not enter the hook of the needle, the base fabric structure can utilize various knitting stitches, for example, a tricot lap stitch, or "1 and 1" stitch, to hold the inlaid yarn 43 in place.

In the raschel knitting stitch diagram 13 shown in FIG. 2, the highlighted area illustrates an area of one repeat 44 of the mesh fabric stitch pattern 13. Table 1 shows the stitch notation for the stitch diagram 13 shown in FIG. 2.

TABLE 1

Stitch Notation for FIG. 2

| Yarn | Stitch Pattern |
|---|---|
| Front yarn | 1-0/1-2// |
| Back Yarn | 0-1/2-1// |
| Elongation Resistant Yarn (Laid in) | 1-1/1-1/1-1/1-1/1-1/0-0// |

The numbers 0, 1, and 2 represent spaces 45 between wales 32, or positions of yarns relative to a set of wales 32. Interwale space "0" (45) represents a space or position on the right hand side of the area of repeat 44 between the wale 32 on the right side in the area of repeat 44 and the adjacent wale 32 just to the right of the area of repeat 44. Interwale space "2" (47) represents a space or position on the left hand side of the area of repeat 44 between the wale 32 on the left side in the area of repeat 44 and the adjacent wale 32 just to the left of the area of repeat 44. Interwale space "1" (46) represents the area or position between spaces, or positions, "0" (45) and "2" (47) between the two adjacent wales 32 in the area of repeat 44. In other words, this stitch notation represents how the guide bars and eyelets move back and forth around needles to knit the fabric 11.

The front yarn 40 (on the first guide bar) can be knit in a 1-0/1-2//repeating pattern. That is, the front yarn 40 can start at the "1" position (46), move to the "0" position (45), form a loop 30 and return to the "1" position (46), then move to the "2" position (47). From the "2" position (47), the front yarn 40 can then form another loop 30 and return to the "1" position (46). This pattern can then be repeated in subsequent courses 34 along the length 33 of the fabric 11. The back yarn 41 (on the second guide bar) can be knit in a 0-1/2-1///repeating pattern. That is, the back yarn 41 can start at the "0" position (45), move around the needle without forming a full loop 30 to the "1" position (46), move to the "2" position (47), around the needle without forming a full loop 30, and back to the "1" position (46). From the "1" position (46), the back yarn 41 can then move to the "0" position (45). The back yarn 41 can repeat this pattern in subsequent courses 34 along the length 33 of the fabric 11.

The elongation resistant inlaid yarn 20 (on the third guide bar) can be knit in a 1-1/1-1/1-1/1-1/1-1/0-0//repeating pattern. In this pattern, the elongation resistant yarn 20 can be laid in between the wales 32 along the "1" position (46) for five courses 34. In the sixth course 48, the elongation resistant yarn 20 can shog to the "0" position (45), evading the loop 30 formed by the front yarn 40. In this manner, the inlaid elongation resistant yarn 20 can be held in position by the knitted construction 31 about the front and back yarns 40, 41, respectively, in the sixth course 48. Such a laying-in technique can be utilized to avoid disruption of the size of the mesh openings, or pores 12, and maintain the integrity of the mesh structure.

In some embodiments of the present invention, the elongation resistant yarn 20 inlaid in the fabric construction can reduce elongation in a direction, in particular, in the walewise direction 49, that is, along the length 33 of the fabric 10. Embodiments comprising such an elongation resistant yarn 20 and knitting technique can be utilized to achieve varying degrees of elongation constraint in the fabric 10 and in a device comprising such a fabric 10.

In some embodiments, the elongation resistant yarn 20 can comprise various materials and/or sizes. For example, in some embodiments the elongation resistant yarn 20 may comprise a single monofilament yarn. In certain embodiments, the monofilament can comprise various fibers, such as polypropylene, polyester, other elongation resistant yarns 20. A polypropylene fiber, for example, has characteristics of good resilience and excellent elastic recovery. In certain embodiments, the elongation-resistant monofilament yarn 20 is preferably larger than other yarns comprised in the fabric 10. In certain embodiments, the monofilament yarn may have a diameter, for example, in the range of 2 mil to 12 mil. A "mil" is defined as a unit of length equal to one thousandth of an inch used to describe diameters of textile monofilament yarns. A 2 mil yarn can have a size equivalent to about 50 denier, and a 6 mil yarn can have a size equivalent to about 150 denier. Such monofilament yarns can be used in mesh fabrics 11 comprising various base yarns and constructions. For example, a 2 mil-12 mil polypropylene yarn laid in the mesh fabric 11 comprising a base construction of polypropylene yarns of about 2 mil (or larger, when the elongation resistant polypropylene yarn 20 is larger than the base yarn) can provide an effective elongation resistant construction.

In an embodiment in which a single monofilament elongation resistant yarn 20 is laid in the mesh fabric knit construction 31, the fabric 11 can have an elongation of about thirty percent with five lbs. of pull force. In some embodiments of the present invention, two monofilament yarns, such as two polypropylene monofilament yarns, can be threaded in alternating eyelets in the third guide bar (that is, in the eyelets comprising the yarns to be laid in). In this manner, a doubled amount of the elongation resistant yarn 20 can be inserted in between alternating wales 32 in the fabric 10. In certain embodiments of the mesh knit construction 31 having a doubled amount of inlaid monofilament yarn 20, the fabric 11 can have an elongation of about 17 percent, or less, with five lbs. of pull force, or as low as nine percent or less with half as much pull force.

The present invention can include alternative embodiments of the elongation resistant fabric 10 and/or device comprising the elongation resistant fabric 10. For example, some embodiments of the present invention can include the fabric 10 having a base construction other than a mesh structure. In such embodiments, for example, in a jersey knit fabric, a rib knit fabric, a tricot-knit fabric, or a fabric having other knitting characteristics, the elongation resistant yarn 20 can be inlaid into the fabric 10 to reduce the ability of the fabric to elongate. In some such embodiments, undesired elongation, or stretch, can be minimized and the knit structure of the fabric maintained when the fabric 10 is pulled in the walewise direction 49. In this way, the original size, shape, and performance characteristics of the fabric 10 can be preserved, thereby prolonging the useful life of the fabric 10. Some embodiments of the present invention can include an elongation resistant yarn 20 other than polypropylene. For example, the elongation resistant yarn 20 can be any yarn or material having less elongation capability than the base yarns knit in the fabric structure.

The length of the elongation resistant yarn 20 introduced into a fabric construction can affect the elongation characteristic of the elongation resistant fabric 10. That is, the shorter the length of the elongation resistant yarn 20 knit into the fabric 10, the less elongation the fabric 10 would be able to undergo. Conversely, the longer the elongation resistant yarn 20 in the fabric 10, the more elongation the fabric 10 would be able to undergo. Therefore, some embodiments of the elongation resistant fabric 10 can include a shorter or longer elongation resistant yarn 20 so as to allow less or more elongation, respectively, to the fabric 10.

In addition, the length of the elongation resistant yarn 20 may affect the integrity (size and shape) of mesh openings, or pores 12. For example, the shorter the elongation resistant yarn 20 in the mesh fabric 11, the less able the fabric 11 would be to elongate and thus the smaller the likelihood the mesh pores 12 would distort upon longitudinal pulling on the fabric 11. Accordingly, some embodiments of the elongation resistant fabric 10 can include a shorter elongation resistant yarn 20 so as to provide more protection against distortion of the mesh pores 12 during fabric elongation. In addition, engineered placement of laid-in yarns 43 in a custom cut material can strategically add stability and/or reduced elongation in selected areas of a device comprising the material.

In some embodiments, the elongation resistant yarns 20 can be placed at different intervals across wales 32. In the embodiment illustrated in the stitch diagram 13 shown in FIG. 2, the elongation resistant yarn 20 is placed in between alternating wales 32. In other embodiments, the elongation resistant yarn 20 can be placed between every wale 32, so as to provide an even greater resistance to elongation in the fabric 10. In still other embodiments, the elongation resistant yarn 20 can be laid in less frequently, for example, adjacent every third wale 32, such that the fabric 10 can have less elongation resistance.

In some embodiments, the fabric 10 can include a mesh design other than the one shown in FIG. 1, in order to enhance resistance to elongation in the fabric 10. For example, the fabric 10 can include a tighter mesh design, that is, having smaller mesh pores 12, that may provide increased resistance to fabric elongation. In some embodiments, the fabric 10 can include a stitch configuration different than the one shown in the stitch diagram 13 in FIG. 2. In certain embodiments, for example, a more tightly knit (or more dense) stitch configuration may provide increased resistance to fabric elongation. In such embodiments having a tighter mesh design and/or a more tightly knit construction, the fabric 10 can include the elongation resistant yarn 20 incorporated into the fabric structure to resist fabric elongation.

Some embodiments of the present invention can include a device comprising the elongation resistant fabric 10 as described herein. An illustrative embodiment of such a device is a medical device (not shown) comprising the mesh fabric 11 having the elongation resistant yarn 20 inlaid in the fabric 11. In certain embodiments, such a medical device can comprise an implantable elongation resistant mesh fabric 11 adapted to provide stability and/or support to an internal body structure. For example, such an implantable elongation resistant device can be utilized to lift, stabilize, and/or support a variety of organs, body tissue, fascia, muscles, and/or other anatomical structures in certain surgical applications. Particular embodiments of devices comprising the elongation resistant fabric 10 may be useful in general surgical procedures, as well as in cosmetic, cardiovascular, gastrointestinal, and/or other surgical procedures.

In some embodiments of a device, the elongation resistant fabric 10 can comprise the elongation resistant yarn 20 laid in a knit structure of the fabric 10 between knit loops 30 in selected adjacent wales 32. The elongation resistant fabric 10 can be laid in partially about the loop 30 in one adjacent wale 32 in predetermined courses 34. In such a device the fabric 10 is adapted to resist elongation in the walewise direction 49 along the length 33 of the fabric 10. In certain embodiments, the device fabric can be the mesh fabric 11. In certain embodiments, the elongation resistant yarn 20 in the device can comprise a diameter larger than the individual diameters of other yarns in the device fabric. In certain embodiments, the device can further comprise an implantable medical device, for example, an implantable organ support device.

The present invention can provide embodiments of a method of making the elongation resistant fabric 10 and devices comprising the elongation resistant fabric 10. The present invention can provide embodiments of a method of using the elongation resistant fabric 10 and devices comprising the elongation resistant fabric 10. Such methods of making and/or using the elongation resistant fabric 10 and devices comprising the elongation resistant fabric 10 can include combining various components of the elongation resistant fabric 10 and devices comprising the elongation resistant fabric 10 as described herein.

In some embodiments of a method, the elongation resistant fabric 10 can be constructed so as to resist elongation in the walewise direction 49 along the length 33 of the fabric 10. Such construction can include laying in the elongation resistant yarn 20 between knit loops 30 in selected adjacent wales 32, and laying in the elongation resistant yarn 20 partially about the loop 30 in one adjacent wale 32 in predetermined courses 34. In certain embodiments, the elongation resistant fabric 10 constructed in such a method can comprise the mesh fabric 11.

In certain embodiments, a method of constructing the elongation resistant fabric 10 can further include knitting on a raschel knitting machine the front yarn 40 from a first guide bar in loops 30 in each wale 32. The back yarn 41 can be knit from a second guide bar about the front yarn loops 30 in each course 34 of the fabric 10. The elongation resistant yarn 20 can be laid in from a third guide bar partially about the loop 30 of the front yarn 40 in one adjacent wale 32 in predetermined courses 34. In certain embodiments, the elongation resistant yarn 20 can be laid in every sixth course 48 along the length 33 of the fabric 10. In certain embodiments of a method, the elongation resistant yarn 20 can comprise a monofilament yarn. The monofilament yarn can comprise, for example, polypropylene, polyester, other elongation resistant yarns 20.

Some embodiments of the elongation resistant fabric 10 and devices comprising the elongation resistant fabric 10 according to the present invention can provide advantages over conventional fabrics and devices. For example, some embodiments of the present invention can provide the mesh fabric 11 having an improved resistance to elongation. Such a fabric 10, 11 having a reduced elongation characteristic can be simple and relatively inexpensive to construct, for example, by utilizing a laying-in technique. Another advantage is that embodiments of the elongation resistant mesh fabric 11, device, and/or method can include the elongation resistant fabric 10 that can maintain the integrity of openings, or pores 12, in the mesh fabric 11.

Features of the elongation resistant fabric 10, devices comprising the elongation resistant fabric 10, and methods of making and/or using an elongation resistant fabric 10 and devices of the present invention may be accomplished singularly, or in combination, in one or more of the embodiments of the present invention. Although particular embodiments have been described, it should be recognized that these embodiments are merely illustrative of the principles of the present invention. Those of ordinary skill in the art will appreciate that the elongation resistant fabric 10, devices, and/methods of the present invention may be constructed and implemented in other ways and embodiments. Accordingly, the description herein should not be read as limiting the present invention, as other embodiments also fall within the scope of the present invention.

What is claimed is:

1. An elongation resistant fabric, comprising:

an elongation resistant yarn laid in between loops in a knit structure of the fabric adjacent only every third wale and partially about the loop in one adjacent wale in only every sixth course along the length of the fabric, wherein the fabric is an implantable mesh fabric adapted to resist elongation in a walewise direction along a length of the fabric.

2. The fabric of claim 1, wherein an original size and shape of pores in the mesh fabric are maintained when the fabric is pulled in the walewise direction.

3. The fabric of claim 1, wherein the mesh fabric comprises a raschel-knit mesh fabric.

4. The fabric of claim 3, wherein each wale comprises a front yarn knit in loops from a first guide bar and a back yarn knit about the front yarn loops from a second guide bar in each course of the fabric structure.

5. The fabric of claim 4, wherein the elongation resistant yarn is laid in the fabric structure from a third guide bar partially about the loop of the front yarn in one adjacent wale in predetermined courses.

6. The fabric of claim 1, wherein the elongation resistant yarn comprises a diameter larger than the individual diameters of other yarns in the fabric.

7. The fabric of claim 1, wherein the elongation resistant yarn comprises a monofilament yarn.

8. The fabric of claim 7, wherein the monofilament yarn comprises polypropylene or polyester.

9. The fabric of claim 7, wherein the monofilament yarn comprises a diameter in the range of 2 mil-12 mil.

10. The fabric of claim 1, wherein the mesh fabric comprises a single monofilament yarn having a 2 mil-12 mil diameter, and wherein the mesh fabric comprises an elongation of about 30 percent in response to a five pound pull force.

11. The fabric of claim 1, wherein the mesh fabric comprises two monofilament yarns, each yarn having a 2 mil-12 mil diameter, and wherein the mesh fabric comprises an elongation of about 17 percent in response to a five pound pull force.

12. A device, comprising:

an elongation resistant fabric comprising an elongation resistant yarn laid in between loops in a knit structure of the fabric adjacent only every third wale and partially about the loop in one adjacent wale in only every sixth course along the length of the fabric, wherein the fabric is an implantable mesh fabric adapted to resist elongation in a walewise direction along a length of the fabric.

13. The device of claim 12, wherein the elongation resistant yarn comprises a diameter larger than the individual diameters of other yarns in the fabric.

14. The device of claim 12, wherein the device further comprises an implantable medical device.

15. The device of claim 14, wherein the implantable medical device comprises an organ support device.

16. A method, comprising:

constructing an implantable mesh, elongation resistant fabric adapted to resist elongation in a walewise direction along a length of the fabric by:

laying in an elongation resistant yarn between knit loops adjacent only every third wale; and laying in the elongation resistant yarn partially about the loop in one adjacent wale in only every sixth course along the length of the fabric.

17. The method of claim 16, wherein constructing an elongation resistant fabric further comprises:

knitting on a raschel knitting machine a front yarn from a first guide bar in loops in each wale;

knitting a back yarn from a second guide bar about the front yarn loops in each course of the fabric; and laying in the elongation resistant yarn from a third guide bar partially about the loop of the front yarn in one adjacent wale in predetermined courses.

18. The method of claim 16, wherein the elongation resistant yarn comprises a monofilament yarn.

19. An elongation resistant fabric, comprising:

an elongation resistant yarn laid in between knit loops in alternating wales and partially about the loop in one adjacent wale in only every sixth course along the length of the fabric, wherein the fabric is an implantable mesh fabric adapted to resist elongation in a walewise direction, and wherein an original size and shape of pores in the mesh fabric are maintained when the fabric is pulled in the walewise direction.

* * * * *